US011208603B2

(12) United States Patent
Bartley et al.

(10) Patent No.: US 11,208,603 B2
(45) Date of Patent: Dec. 28, 2021

(54) AMINE SALTS FOR USE IN GASOLINE ENGINES

(71) Applicant: The Lubrizol Corporation, Wickliffe, OH (US)

(72) Inventors: Stuart L. Bartley, Wickliffe, OH (US); Matthew Nyce, Akron, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 107 days.

(21) Appl. No.: 16/643,346

(22) PCT Filed: Mar. 5, 2018

(86) PCT No.: PCT/US2018/020846

§ 371 (c)(1),
(2) Date: Feb. 28, 2020

(87) PCT Pub. No.: WO2018/164986

PCT Pub. Date: Sep. 13, 2018

(65) Prior Publication Data

US 2020/0255756 A1 Aug. 13, 2020

Related U.S. Application Data

(60) Provisional application No. 62/550,753, filed on Aug. 28, 2017, provisional application No. 62/467,292, filed on Mar. 6, 2017.

(51) Int. Cl.

| | |
|---|---|
| ***C10L 1/222*** | (2006.01) |
| ***C10L 1/182*** | (2006.01) |
| ***C10L 1/224*** | (2006.01) |
| ***C10L 10/06*** | (2006.01) |
| ***C10L 1/2387*** | (2006.01) |

(52) U.S. Cl.

CPC ..... *C10L 1/2225* (2013.01); *C10L 1/1824* (2013.01); *C10L 1/224* (2013.01); *C10L 1/2387* (2013.01); *C10L 10/06* (2013.01); *C10L 2200/0423* (2013.01); *C10L 2270/023* (2013.01)

(58) Field of Classification Search

CPC .... C10L 1/1824; C10L 1/2225; C10L 1/2387; C10L 10/06; C10L 1/1616; C10L 1/1905; C10L 1/191; C10L 1/1985; C10L 1/224; C10L 1/238; C10L 1/2383; C10L 2200/0423; C10L 2270/023; C10L 10/08; C10L 1/1608; C10L 1/1881; C10L 1/1883

See application file for complete search history.

(56) References Cited

U.S. PATENT DOCUMENTS

| | | | | |
|---|---|---|---|---|
| 3,687,644 | A | 5/1970 | Delafield et al. | |
| 4,253,876 | A | 3/1981 | Godar et al. | |
| 9,340,742 | B1 | 5/2016 | Fang et al. | |
| 2008/0168708 | A1 | 7/2008 | Cunningham et al. | |
| 2014/0157657 | A1 * | 6/2014 | Reid | C10L 1/2383 44/399 |
| 2014/0238328 | A1 * | 8/2014 | Fang | C10L 1/2222 123/1 A |

FOREIGN PATENT DOCUMENTS

| | | | | |
|---|---|---|---|---|
| EP | 1518918 | A1 | 3/2005 | |
| EP | 1967567 | A2 | 9/2008 | |
| WO | WO-2012162219 | A1 * | 11/2012 | C10L 10/18 |

OTHER PUBLICATIONS

The International Search Report and Written Opinion of the International Searching Authority, dated May 28, 2018.
PCT International Search Report, dated May 28, 2018.
Written Opinion of the International Searching Authority, dated May 28, 2018.

* cited by examiner

*Primary Examiner* — Ellen M McAvoy
*Assistant Examiner* — Chantel L Graham
(74) *Attorney, Agent, or Firm* — Iken S. Sans; Teresan W. Gilbert

(57) ABSTRACT

Fuel compositions comprising at least 10 ppm by weight of a succinic ester acid amine salt or a succinamide acid amine salt (both "amine salt(s)"). The amine salt is the product of (a) and (b), wherein: (a) is an amine with (i) at least one tertiary nitrogen and (ii) at least one hydroxy alkyl functional group and/or at least one secondary amine functionality; and (b) is a hydrocarbyl-substituted succinic acid/or anhydride. The molar ratio of (a) to (b) may range from 3:1 to 1:3. The fuel composition may comprise gasoline, oxygenate, or mixtures thereof. Methods and uses for reducing carbonaceous deposits in an engine comprising operating the engine using the fuel composition having an amine salt therein.

18 Claims, 3 Drawing Sheets

AMINE SALTS FOR USE IN GASOLINE ENGINES

CROSS REFERENCE TO RELATED APPLICATION

This application claims priority from PCT Application Serial No. PCT/US2018/020846 filed on Mar. 5, 2018, which claims the benefit of U.S. Provisional Application No. 62/550,753 filed on Aug. 28, 2017, which claims the benefit of U.S. Provisional Application No. 62/467,292 filed on Mar. 6, 2017, all of which are incorporated in their entirety by reference herein.

FIELD OF THE INVENTION

The field of the disclosed technology is generally related to fuel additive compositions comprising amine salts of succinic esters or acids.

BACKGROUND OF THE INVENTION

In gasoline direct injection ("GDI") engines, a highly-atomized mist of fuel is injected directly into the combustion chamber of each engine cylinder under high pressures, typically between 450 and 3,000 psi. By injecting the fuel directly into the combustion chamber, GDI engines have increased fuel efficiency and higher power output compared to conventional port fuel injection gasoline ("PFI") engines wherein the fuel is directed into a cylinder intake port. This has led to a rapid adoption of GDI engines in the automotive industry.

The fuel injectors of GDI engines are prone to carbon build-up or "deposits" because of the injectors' proximity to the combustion chamber. These deposits can affect the spray pattern of fuel passing through the nozzle of the injector and reduce the amount of fuel entering into the combustion chamber.

Detergents, such as Mannich compounds and polyetheramines, are added to gasoline fuels to help keep injectors clean ("keep-clean") or remove deposit build-up ("clean-up") in the injectors and elsewhere in the engine.

Moreover, tests have shown that GDI engines emit higher numbers of small particles in their emissions compared to PFI engines. New legislation has been introduced in Europe to regulate the number of particles of passenger vehicles to below $6\times10^{11}$ per km. It is expected that other regions, including the United States, may introduce similar emissions standards. In response to the European standard, automobile manufacturers are planning to install gasoline particulate filters, but filters are expensive, marginally effective for removing very small particles, could interfere with the automobile operability, and require servicing or replacing when they become clogged.

Corrosion or rust inhibitors may also be added to fuels to prevent corrosion of the internal surfaces of the engine. Some corrosion inhibitors may neutralize acid compounds in the fuel to reduce corrosion. Other corrosion inhibitors may reduce corrosion by forming a protective film on the metal surface. Corrosion inhibitors are generally effective at reducing corrosion when they are added to fuels in amounts ranging from 1- to 10 ppm, or 2 to 3 ppm by weight of the total fuel composition.

SUMMARY OF THE INVENTION

It was found that corrosion inhibitors comprising amine salts of succinic esters or acids, when added in to fuels in amounts greater than 10 ppm were surprisingly effective at preventing and removing carbon deposits in GDI engines. Accordingly, a fuel composition comprising at least 10 ppm by weight of a succinic ester acid amine salt or a succinamide acid amine salt (both "amine salt(s)") is disclosed. The amine salt is the product of (a) and (b), wherein: (a) is an amine with (i) at least one tertiary nitrogen and (ii) at least one hydroxy alkyl functional group and/or at least one secondary amine functionality; and (b) is a hydrocarbyl-substituted succinic acid/or anhydride. The molar ratio of (a) to (b) may range from 3:1 to 1:3. The fuel composition may comprise gasoline, oxygenate, or mixtures thereof.

In one embodiment, at least a portion of the amine salt has the formula (I):

(I)

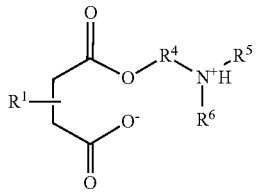

wherein $R^1$ is hydrogen or a $C_1$ to $C_{50}$ linear or branched hydrocarbyl group; $R^4$ is a $C_1$ to $C_5$ linear or branched hydrocarbyl group; and $R^5$ and $R^6$ are independently hydrogen, a $C_1$ to $C_{22}$ linear or branched hydrocarbyl group, or are moieties which, taken together with the carbon atoms to which they are bonded, form a 5-, 6-, or 7-membered ring. In yet another embodiment, the amine salt may be the product of N-methyldiethanolamine and N-hexadecenylsuccinic anhydride.

In another embodiment, at least a portion of the amine salt has the formula (II):

(II)

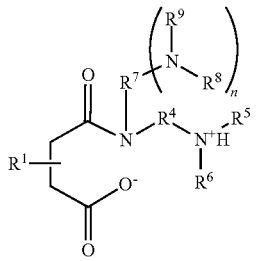

wherein $R^1$ is hydrogen or a $C_1$ to $C_{50}$ linear or branched hydrocarbyl group; $R^4$ and $R^7$ are independently a $C_1$ to $C_5$ linear or branched hydrocarbyl group; and $R^5$, $R^6$, are independently hydrogen, a C1, to $C_{22}$ linear or branched hydrocarbyl group, or are moieties which, when taken together, form a 5-, 6-, or 7-membered ring, n is 0 or 1, and $R^8$ and $R^9$ are independently hydrogen or a $C_1$ to $C_{22}$ linear or branched hydrocarbyl group, or are moieties which, when taken together, form a 5-, 6-, or 7-membered ring In some embodiments, the amine used to make the amine salt may be an alkoxylated fatty amine. In yet other embodiments, the fuel composition may further comprise an alkoxylated fatty amine in addition to the tertiary amine used to make the amine salt. The alkoxylated fatty amine used to make the amine salt, and/or added to the fuel composition may have the formula (III):

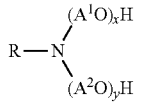

(III)

wherein R is a $C_4$ to $C_{30}$ hydrocarbyl group; $A^1$ and $A^2$ are individually a $C_1$ to $C_{10}$ alkylene group; and the sum of x and y is an integer of at least 1.

The amine salt may be present in the fuel composition in an amount of at least 10 ppm, 12 ppm, 25 ppm, or 50 ppm to 100ppm, 500 or 2500 ppm, based on a total weight of the fuel composition.

The fuel may comprise gasoline, oxygenate, or mixtures thereof. In one embodiment, the fuel composition may comprise 0.1 vol % to 100 vol % oxygenate, based on a total volume of the fuel composition. In yet another embodiment, the fuel composition may comprise 0.1 vol % to 100 vol % gasoline, based on a total volume of the fuel composition. In yet another embodiment, the oxygenate may be ethanol. In other embodiments, the fuel composition may comprise gasoline and 5 vol % to 30 vol % ethanol.

Methods of reducing carbonaceous deposits in an engine are also disclosed. The method may comprise operating the engine using the fuel composition described above. The amine salt may be present in the fuel composition in an amount of at least 10 ppm or 20 ppm to 100 ppm ("keep clean"), or at least 100 ppm to 500 ppm ("clean-up") by weight based on a total weight of the fuel composition. The engine may be a gasoline direct injection ("GDI") engine, a port fuel injection ("PFI") engine, a homogeneous charge compression ignition ("HCCI") engine, or a combination thereof. In some embodiments, the amine salt may be added to a fuel using an onboard dosing system.

The fuel composition described above may be used to reduce carbonaceous deposits in an engine operated on the fuel composition. In some embodiments, the amine salt is present in an amount of at least 10 ppm or 20 ppm to 100 ppm ("keep clean"), or at least 100 ppm to 500 ppm ("clean-up") by weight based on a total weight of the fuel composition. The additive composition may be used in an internal combustion engine. In some embodiments, the engine may be a gasoline direct injection ("GDI") engine, port fuel injection ("PFI") engine, a homogeneous charge compression ignition ("HCCI") engine, or combinations thereof.

DETAILED DESCRIPTION OF THE INVENTION

Figure 1:
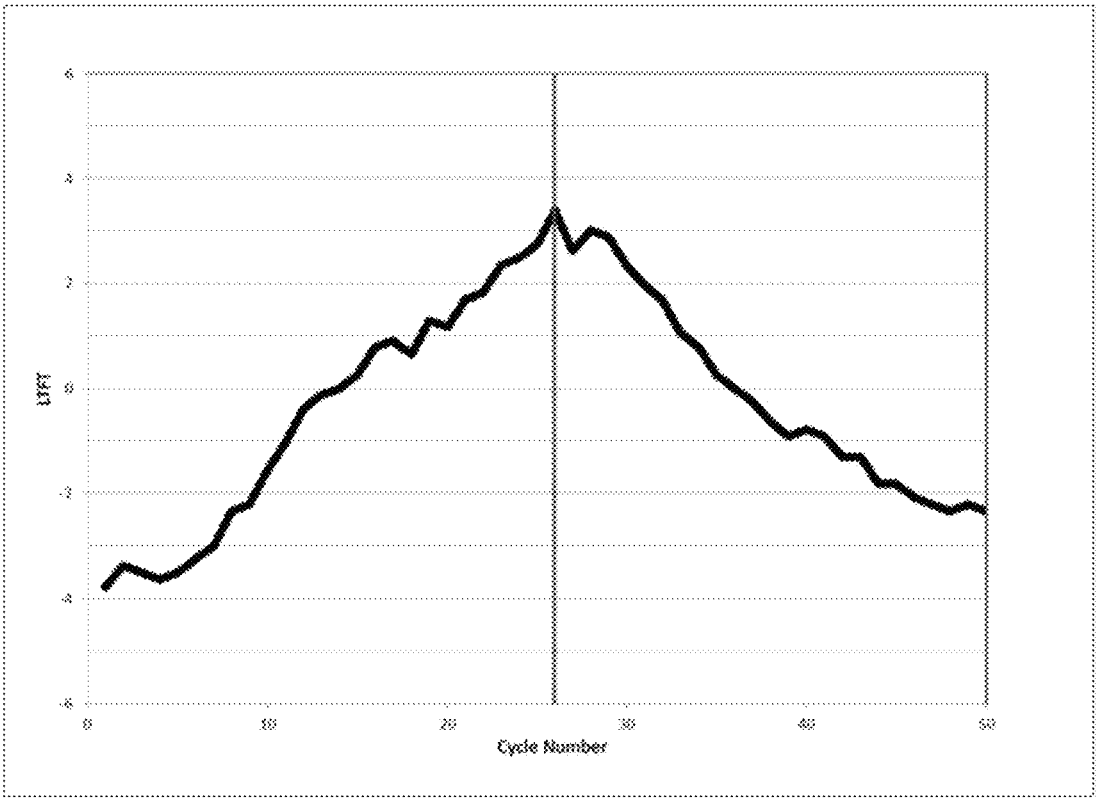
FIG. 1 shows the dirty-up cycles of the baseline unadditized gasoline, followed by the clean-up cycles of Comp 1, a gasoline having 3000 ppm of Comp A.

Various features and embodiments will be described below by way of non-limiting illustrations. In one embodiment, a fuel composition comprising at least 10 ppm by weight of a succinic ester acid amine salt or a succinamide acid amine salt (both "amine salt(s)") is disclosed. The amine salt is the product of (a) and (b), wherein: (a) is an amine with (i) at least one tertiary nitrogen and (ii) at least one hydroxy alkyl functional group and/or at least one secondary amine functional group; and (b) is a hydrocarbyl-substituted succinic acid/or anhydride. The molar ratio of (a) to (b) may range from 3:1 to 1:3. The fuel composition may comprise gasoline, oxygenate, or mixtures thereof.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

The Amine with At Least One Tertiary Nitrogen and (i) At Least One Hydroxy Alkyl Functional Group and (ii) At Least One Secondary Amine Group Amines suitable for making the amine salt are not overly limited provided the amine with (i) at least one tertiary nitrogen and (ii) at least one hydroxyl alkyl functionality and/or at least one secondary amine functionality. As used herein "functionality" can be interchanged with "functional group". The amines may be mono-, di-, or polyamines, and include cyclic amines. For monoamines, the amine will be tertiary and have at least one hydroxyl alkyl functional group. If the amine is a diamine, one nitrogen must be tertiary and the other must be secondary. If the amine is a polyamine, at least one nitrogen is tertiary and at least one nitrogen is secondary, and the remaining nitrogens may be secondary, tertiary, or a combination thereof. The polyamine may or may not have at least one hydroxyl alkyl functional group. Exemplary amines include, but are not limited to, triethanolamine, N,N-dimethylaminopropanol, N,N-diethylaminopropanol, N,N-diethylaminobutanol, triisopropanolamine, 1-[2-hydroxyethyl]piperidine, 1[2-hydroxyethyl] piperazine, 1[2-hydroxyethyl]-4-hyrocarbyl-piperazine 1,4-bis[2-hydroxyethyl]piperazine 4[2-hydroxyethyl] morpholine, 2-[2-(dimethyl amine)ethoxy]-ethanol, N-ethyldiethanolamine, N-methyldiethanolamine, N-butyldiethanolamine, N,N-diethylaminoethanol, N,N-dimethylaminoethanol, 2-dimethyl amino-2-methyl-1-propanol, and N1-(3-(dimethylamino)propyl)-N3,N3-dimethylpropane-1,3-diamine.

Additional amines suitable for making the amine salt include alkoxylated fatty amines, for example polyethoxylated tallow amine. The alkoxylated fatty amines may have the formula (III):

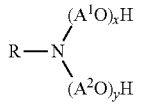

(III)

wherein R is a $C_4$ to $C_{30}$ hydrocarbyl group; $A^1$ and $A^2$ are individually a $C_1$ to $C_{10}$ alkylene group; and the sum of x and y is an integer of at least 1.

The Hydrocarbyl-Substituted Succinic Acid or Anhydride

The hydrocarbyl-substituted succinic acids and anhydrides suitable for making the amine salt include dimer acids. Dimer acids are a type of di-acid polymer derived from fatty acids and/or polyolefins and include polyalkenes containing acid functionality. In some embodiments, the dimer acid is derived from $C_{10}$ to $C_{20}$ polyolefins, $C_{12}$ to $C_{18}$ polyolefins, and/or $C_{16}$ to $C_{18}$ polyolefins.

The hydrocarbyl group of the hydrocarbyl-substituted succinic acid or anhydride generally contains an average of at least about 8, or about 30, or about 35 up to about 350, or to about 200, or to about 100 carbon atoms. In one embodiment, the hydrocarbyl group is derived from a polyalkene.

The polyalkene may be characterized by a $M_n$ (number average molecular weight) of at least about 300. Generally, the polyalkene is characterized by an $M_n$ of about 500, or about 700, or about 800, or even about 900 up to about 5000, or to about 2500, or to about 2000, or even to about 1500. In another embodiment, n varies between about 300, or about 500, or about 700 up to about 1200 or to about 1300.

As used herein, the number average molecular weight ($M_n$) is measured using gel permeation chromatography ("GPC") (Waters GPC 2000) based on polystyrene standards. The instrument is equipped with a refractive index detector and Waters Empower™ data acquisition and analysis software. The columns are polystyrene (PLgel, 5 micron, available from Agilent/Polymer Laboratories, Inc.). For the mobile phase, individual samples are dissolved in tetrahydrofuran and filtered with PTFE filters before they are injected into the GPC port.

Waters GPC 2000 Operating Conditions:

Injector, Column, and Pump/Solvent compartment temperatures: 40° C.

Autosampler Control: Run time: 40 minutes

Injection volume: 300 microliter

Pump: System pressure: ~90 bars (Max. pressure limit: 270 bars, Min. pressure limit: 0 psi)

Flow rate: 1.0 ml/minute

Differential Refractometer (RI): Sensitivity: −16; Scale factor: 6

The polyalkenes include homopolymers and interpolymers of polymerizable olefin monomers of 2 to about 16 or to about 6, or to about 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the interpolymer is a homopolymer. An example of a polymer is a polybutene. In one instance about 50% of the polybutene is derived from isobutylene. The polyalkenes are prepared by conventional procedures.

In one embodiment, the hydrocarbyl groups are derived from polyalkenes having an $M_n$ of about 200 to at least about 1300, or about 1500, or about 1600 up to about 5000, or to about 3000, or to about 2500, or to about 2000, or to about 1800, and the $M_w/M_n$ is from about 1.5 or about 1.8, or about 2, or to about 2.5 to about 3.6, or to about 3.2. In some embodiments the polyalkene is polyisobutylene with a molecular weight of 200 to 550. In yet another embodiment the polyalkene is N-hexadecenylsuccinic anhydride ("HDSA") having an $M_n$ of about 225.

In one embodiment, the hydrocarbyl-substituted succinic acids and anhydrides may be prepared by reacting the above described polyalkene with an excess of maleic anhydride to provide substituted succinic compounds wherein the number of succinic groups for each equivalent weight of substituent group is at least 1.3, or to about 1.5, or to about 1.7, or to about 1.8. The maximum number generally will not exceed 4.5, or to about 2.5, or to about 2.1, or to about 2.0.

In another embodiment, the hydrocarbyl group contains an average from about 8, or about 10, or about 12 up to about 40, or to about 30, or to about 24, or to about 20 carbon atoms. In one embodiment, the hydrocarbyl group contains an average of 16 to 18 carbon atoms. In another embodiment, the hydrocarbyl group is a tetrapropenyl group. In one embodiment, the hydrocarbyl group is an alkenyl group.

The hydrocarbyl group may be derived from one or more olefins having from about 2 to about 40 carbon atoms or oligomers thereof. These olefins are preferably alpha-olefins (sometimes referred to as mono-1-olefins) or isomerized alpha-olefins. Examples of the alpha-olefins include ethylene, propylene, butylene, 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, etc. Commercially available alpha-olefin fractions that may be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc. In one embodiment, the olefins are $C_{16}$ and $C_{16-18}$ alpha-olefins. Additionally, $C_{30}$+ alpha-olefin fractions such as those available from Gulf Oil Company under the name Gulftene can be used. In one embodiment, the olefin monomers include ethylene, propylene and 1-butene.

Isomerized alpha-olefins are alpha-olefins that have been converted to internal olefins. The isomerized alpha-olefins suitable for use herein are usually in the form of mixtures of internal olefins with some alpha-olefins present. The procedures for isomerizing alpha-olefins are well known to those in the art. Briefly, these procedures involve contacting alpha-olefin with a cation exchange resin at a temperature in a range of about 80 to about 130° C. until the desired degree of isomerization is achieved.

The mono-olefins may be derived from the cracking of paraffin wax. The wax cracking process yields both even and odd number $C_{6-20}$ liquid olefins of which 85% to 90% are straight chain 1-olefins. The balance of the cracked wax olefins is made up of internal olefins, branched olefins, diolefins, aromatics and impurities. Distillation of the $C_{6-20}$ liquid olefins, obtained from the wax cracking process, yields fractions (e.g., $C_{15-18}$ alpha-olefins) which are useful in preparing the succinic acylating agents.

Other mono-olefins can be derived from the ethylene chain growth process. This process yields even numbered straight-chain 1-olefins from a controlled Ziegler polymerization. Other methods for preparing the mono-olefins include chlorination-dehydrochlorination of paraffin and catalytic dehydrogenation of paraffins.

The succinic acids and anhydrides may be prepared by reacting the above-described olefins, isomerized olefins or oligomers thereof with unsaturated carboxylic acylating agents, such as itaconic, citraconic, or maleic acylating agents at a temperature of about 160°, or about 185° C. up to about 240° C., or to about 210° C. The procedures for preparing the acylating agents are well known to those skilled in the art.

In one embodiment, the alkenyl group is derived from oligomers of lower olefins, i.e., olefins containing from 2 to about 6, or about 4 carbon atoms. Examples of these olefins include ethylene, propylene and butylene.

The olefin, olefin oligomer, or polyalkene may be reacted with the carboxylic reagent such that there is at least one mole of carboxylic reagent for each mole of olefin, olefin oligomer, or polyalkene that reacts. An excess of carboxylic reagent may be used. In one embodiment, this excess is between about 5% to about 25%. In another embodiment, the excess is greater than 40%, or greater than 50%, and even greater than 70%.

The conditions, i.e., temperature, agitation, solvents, and the like, for forming the hydrocarbyl-substituted succinic acylating agent, are known to those in the art.

In some embodiments the hydrocarbyl substituted succinic acids or anhydrides contain di-acid functionality. In other embodiments, which may be used alone or in combination with the embodiments described above, the hydrocarbyl group of the hydrocarbyl substituted succinic acid or anhydride is derived from polyisobutylene and the di-acid functionality of the agent is derived from carboxylic acid groups, such as hydrocarbyl substituted succinic acid.

In some embodiments the hydrocarbyl substituents of the substituted succinic acids or anhydrides described above are derived from homopolymers and/or copolymers containing 2 to 10 carbon atoms. In some embodiments the hydrocarbyl substituents are derived from polyisobutylene. In yet other embodiments, the hydrocarbyl substituents are derived from N-hexadecenylsuccinic anhydride.

Organic Solvent

In one embodiment, the fuel composition further comprises (c) an organic solvent. The organic solvent may be added to the amine salt or be included in a fuel additive package comprising the amine salt, the organic solvent, and other fuel additives. The organic solvent may provide for a homogeneous and liquid amine salt composition and/or fuel additive package that facilitates handling. The organic solvent may also provide for a homogeneous fuel composition comprising gasoline and the additive composition.

In some embodiments, the organic solvent may be an aliphatic or aromatic hydrocarbon. These types of organic solvents generally boil in the range of about 65° C. to 235° C. Aliphatic hydrocarbons include various naphtha and kerosene boiling point fractions that have a majority of aliphatic components. Aromatic hydrocarbons include benzene, toluene, xylenes and various naphtha and kerosene boiling point fractions that have a majority of aromatic components. Additional organic solvents include aromatic hydrocarbons and mixtures of alcohols with aromatic hydrocarbons or kerosene having enough aromatic content that allows the additive composition to be a fluid at a temperature from about 0° C. to minus 18° C. The aliphatic or aromatic hydrocarbon may be present at about 0 to 70 wt %, 0 to 50 wt %, 0 to 40 wt %, 0 to 35 wt %, or 0 to 30 wt %, based on a total weight of the amine salt and/or additive package.

In some embodiments, the organic solvent may be an alcohol. Alcohols can be aliphatic alcohols having about 2 to 16 or 2 to 10 carbon atoms. In one embodiment, the alcohol can be ethanol, 1-propanol, isopropyl alcohol, 1-butanol, isobutyl alcohol, amyl alcohol, isoamyl alcohol, 2-methyl-1-butanol, and 2-ethylhexanol. The alcohol can be present in the additive composition at about 0 to 40 wt %, 0 to 30 wt %, or 0 to 20 wt %, based on total weight of the amine salt and/or additive package.

The organic solvent may comprise at least one of 2-ethylhexanol, naphtha, dimethylbenzene ("xylene"), or mixtures thereof. Naphtha can include heavy aromatic naphtha ("HAN"). Accordingly, in one embodiment, the organic solvent may comprise at least one of 2-ethylhexanol, naphtha, dimethylbenzene, or mixtures thereof.

Amine Salt

In one embodiment, at least a portion of the amine salt has the formula (I) or (II):

(I)

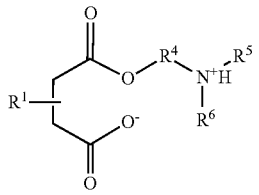

(II)

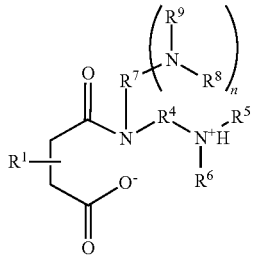

wherein $R^1$ is hydrogen or a $C_1$ to $C_{50}$ linear or branched hydrocarbyl group; $R^4$ and $R^7$ are independently a $C_1$ to $C_5$ linear or branched hydrocarbyl group; and $R^5$ and $R^6$, are independently hydrogen, a C1, to $C_{22}$ linear or branched hydrocarbyl group, or are moieties which, when taken together, form a 5-, 6-, or 7-membered ring, n is 0 or 1, and $R^8$ and $R^9$ are independently hydrogen, a $C_1$ to $C_{22}$ linear or branched hydrocarbyl group, or are moieties which, when taken together, form a 5-, 6-, or 7-membered ring. In one embodiment, $R^5$ and $R^6$ in either formula (I) or (II), are independently a C1, to $C_{22}$ linear or branched hydrocarbyl group, or are moieties which, when taken together, form a 5-, 6-, or 7-membered ring. In another embodiment, $R^5$ and $R^6$ in either formula (I) or (II), are independently a C1, to $C_{22}$ linear or branched hydrocarbyl group. In another embodiment, n is 1 and $R^8$and $R^9$are independently a $C_1$ to $C_{22}$ linear or branched hydrocarbyl group, or are moieties which, when taken together, form a 5-, 6-, or 7-membered ring. In yet another embodiment, n is 1 and $R^5$, $R^6$, $R^8$and $R^9$are independently a $C_1$ to $C_{22}$ linear or branched hydrocarbyl group.

In one embodiment, $R^1$ may be a $C_8$ to $C_{25}$ or $C_{12}$ to $C_{16}$ hydrocarbyl group. In another embodiment, $R^1$ is a $C_{16}$ hydrocarbyl group; $R^4$ is a $C_2$ hydrocarbyl group; and both $R^5$ and $R^6$ are methyl groups. In yet another embodiment, the amine salt may be the product of N-methyldiethanolamine and N-hexadecenylsuccinic anhydride.

In another embodiment, at least a portion of the amine salt may have the formula (IV):

(IV)

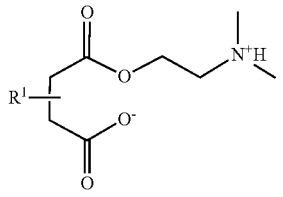

wherein $R^1$ is hydrogen or a $C_1$ to $C_{50}$ linear or branched hydrocarbyl group. In one embodiment, $R^1$ is a $C_{12}$ to $C_{20}$ linear or branched hydrocarbyl group. In yet another embodiment, $R^1$ is a $C_{16}$ linear hydrocarbyl group. It yet other embodiments, the amine salt may comprise the product of hexadecenylsuccinic anhydride ("HDSA") and N,N-dimethylethanolamine (N,N-dimethylaminoethanol).

In another embodiment, at least a portion of the amine salt may have the formula (V):

(V)

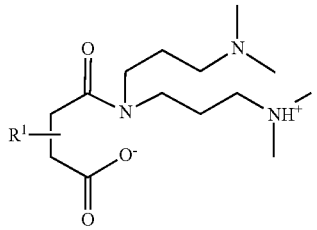

wherein $R^1$ is hydrogen or a $C_1$ to $C_{50}$ linear or branched hydrocarbyl group. In one embodiment, $R^1$ is a $C_{12}$ to $C_{20}$ linear or branched hydrocarbyl group. In yet another embodiment, $R^1$ is a $C_{16}$ linear hydrocarbyl group. It yet other embodiments, the amine salt may comprise the product of hexadecenylsuccinic anhydride ("HDSA") and N1-(3-(dimethylamino)propyl)-N3,N3-dimethylpropane-1,3-diamine.

In yet other embodiments, the amine salt may have the formulas above, wherein $R^1$ may be a linear or branched $C_8$ to $C_{25}$ hydrocarbyl group. Exemplary hydrocarbyl groups include, but are not limited to, $C_8$ to $C_{18}$, $C_{10}$ to $C_{16}$, or $C_{13}$ to $C_{17}$, linear or branched hydrocarbyl groups. In one embodiment, $R^1$ may be a linear or branched $C_{12}$ to $C_{16}$ hydrocarbyl group. In one embodiment, $R^1$ may be dodecyl or hexadecyl group. In yet another embodiment, $R^1$ may be a linear dodecyl or linear hexadecyl group. In yet other embodiments, $R^1$ may be a polyisobutylene ("PIB") group having a number average molecular weight ("$M_n$") of 250 to 650, or 350 to 550.

In some embodiments, the amine used to make the amine salt may be an alkoxylated fatty amine. In yet other embodiments, the fuel composition may further comprise an alkoxylated fatty amine in addition to the tertiary amine used to make the amine salt. The alkoxylated fatty amine used to make the amine salt, and/or added to the fuel composition may have the formula (III):

(III)

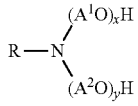

wherein R is a $C_4$ to $C_{30}$ hydrocarbyl group; $A^1$ and $A^2$ are individually a $C_1$ to $C_{10}$ alkylene group; and the sum of x and y is an integer of at least 1.

Fuel

The fuel composition comprises a fuel which is liquid at room temperature and is useful in fueling an engine. The fuel is normally a liquid at ambient conditions e.g., room temperature (20 to 30° C.). The fuel can be a hydrocarbon fuel, a non-hydrocarbon fuel, or a mixture thereof. The hydrocarbon fuel can be a hydrocarbon prepared by a gas to liquid process to include for example hydrocarbons prepared by a process such as the Fischer-Tropsch process. The hydrocarbon fuel can be a petroleum distillate to include a gasoline as defined by ASTM specification D4814. In one embodiment the fuel is a gasoline, and in other embodiments the fuel is a leaded gasoline or a nonleaded gasoline. The nonhydrocarbon fuel can be an oxygen containing composition, often referred to as an oxygenate, to include an alcohol, an ether, a ketone, an ester of a carboxylic acid, a nitroalkane, or a mixture thereof. The nonhydrocarbon fuel can include, for example, methanol, ethanol, butanol, methyl t-butyl ether, methyl ethyl ketone. In several embodiments, the fuel can have an oxygenate content on a volume basis that is 1 percent by volume, or 10 percent by volume, or 50 percent by volume, or up to 85 percent by volume. In yet other embodiments, the fuel can have an oxygenate content of essentially 100 percent by volume (minus any impurities or contaminates, such as water). Mixtures of hydrocarbon and nonhydrocarbon fuels can include, for example, gasoline and methanol and/or ethanol. The ethanol may be a fuel-grade ethanol according to ASTM D4806. In various embodiments, the liquid fuel can be an emulsion of water in a hydrocarbon fuel, a nonhydrocarbon fuel, or a mixture thereof.

The fuel may comprise gasoline, oxygenate, or mixtures thereof. In one embodiment, the fuel composition may comprise 0.1 vol % to 100 vol % oxygenate, based on a total volume of the fuel composition. In yet another embodiment, the fuel composition may comprise 0.1 vol % to 100 vol % gasoline, based on a total volume of the fuel composition. In yet another embodiment, the oxygenate may be ethanol. In other embodiments, the fuel composition may comprise gasoline and 5 vol % to 30 vol % ethanol.

Methods of reducing carbonaceous deposits in an engine are also disclosed. The method may comprise operating the engine using the fuel composition comprising the amine salt described above. The amine salt may be present in an amount of at least 10 or 20 ppm to 100 ppm ("keep clean"), or at least 100 ppm to 500 ppm ("clean-up") based on a total weight of the fuel. It is generally understood that keep clean treat rates are treat rates that are sufficient to keep an engine clean of carbonaceous deposits whereas cleanup treat rates are generally higher concentrations to remove a buildup of carbonaceous deposits in an engine.

Additional Performance Additives

The fuel compositions described above can further comprise one or more additional performance additives. These additional performance additives can be based on several factors such as the type of internal combustion engine and the type of fuel being used in that engine, the quality of the fuel, and the service conditions under which the engine is being operated. The additional performance additives can include an antioxidant such as a hindered phenol or derivative thereof and/or a diarylamine or derivative thereof, a corrosion inhibitor such as an alkenylsuccinic acid, including PIB succinic acid, and/or a detergent/dispersant additive such as a polyetheramine or nitrogen containing detergent, including but not limited to PIB amine dispersants, Mannich dispersants, quaternary salt dispersants, and succinimide dispersants.

Further additives can include, dyes, bacteriostatic agents and biocides, gum inhibitors, marking agents, and demulsifiers, such as polyalkoxylated alcohols. Other additives can include lubricity agents, such as fatty carboxylic acids, metal deactivators such as aromatic triazoles or derivatives thereof, and valve seat recession additives such as alkali metal sulfosuccinate salts. Additional additives can include, antistatic agents, de-icers, and combustion improvers such as an octane or cetane improver.

Fluidizer

In one embodiment, the additional additives can comprise fluidizers such as mineral oil and/or poly(alpha-olefins) and/or polyethers. In another embodiment, the fluidizer can be a polyetheramine. In another embodiment, the polyetheramine can be a detergent. The polyetheramine can be represented by the formula $R[OCH_2CH(R^1)]nA$, where R is a hydrocarbyl group, $R^1$ is selected from the group consisting of hydrogen, hydrocarbyl groups of 1 to 16 carbon atoms, and mixtures thereof, n is a number from 2 to about 50, and A is selected from the group consisting of $—OCH_2CH_2CH_2NR^2R^2$ and $—NR^3R^3$, where each $R^2$ is independently hydrogen or hydrocarbyl, and each $R^3$ is independently hydrogen, hydrocarbyl or $—[R^4N(R^5)]pR^6$, where $R^4$ is $C_2$-$C_{10}$ alkylene, $R^5$ and $R^6$ are independently hydrogen or hydrocarbyl, and p is a number from 1-7. These polyetheramines can be prepared by initially condensing an alcohol or alkylphenol with an alkylene oxide, mixture of alkylene oxides or with several alkylene oxides in sequential fashion in a 1:2-50 mole ratio of hydric compound to alkylene oxide to form a polyether intermediate. U.S. Pat. No. 5,094,667 provides reaction conditions for preparing a polyether intermediate, the disclosure of which is incorporated herein by reference. In one embodiment, the alcohols can be linear or branched from 1 to 30 carbon atoms, in another embodiment 6 to 20 carbon atoms, in yet another embodiment from 10 to 16 carbon atoms. The alkyl group of the alkylphenols can be 1 to 30 carbon atoms, in another embodiment 10 to 20 carbon atoms. Examples of the alkylene oxides include ethylene oxide, propylene oxide or butylene oxide. The number of alkylene oxide units in the polyether intermediate can be 10-35 or 18-27. The polyether intermediate can be converted to a polyetheramine by amination with ammonia, an amine or a polyamine to form a polyetheramine of the type where A is $—NR^3R^3$. Published Patent Application EP310875 provides reaction conditions for the amination reaction, the disclosure of which is incorporated herein by reference. Alternately, the polyether intermediate can also be converted to a polyetheramine of the type where A is $—OCH_2CH_2CH_2NR^2R^2$ by reaction with acrylonitrile followed by hydrogenation. U.S. Pat. No. 5,094,667 provides reaction conditions for the cyanoethylation and subsequent hydrogenation, the disclosure of which is incorporated herein by reference. Polyetheramines where A is $—OCH_2CH_2CH_2NH_2$ are typically preferred. Commercial examples of polyetheramines are the Techron™ range from Chevron and the Jeffamine™ range from Huntsman.

In another embodiment, the fluidizer can be a polyether, which can be represented by the formula $R^7O[CH_2CH(R^8)O]qH$, where $R^7$ is a hydrocarbyl group, $R^8$ is selected from the group consisting of hydrogen, hydrocarbyl groups of 1 to 16 carbon atoms, and mixtures thereof, and q is a number from 2 to about 50. Reaction conditions for preparation as well as various embodiments of the polyethers are presented above in the polyetheramine description for the polyether intermediate. A commercial example of a polyether is the Lyondell ND™ series. Other suitable polyethers are also available from Dow Chemicals, Huntsman, and Akzo.

In yet another embodiment, the fluidizer can be a hydrocarbyl-terminated poly-(oxyalklene) aminocarbamate as described U.S. Pat. No. 5,503,644.

In yet another embodiment, the fluidizer can be an alkoxylate, wherein the alkoxylate can comprise: (i) a polyether containing two or more ester terminal groups; (ii) a polyether containing one or more ester groups and one or more terminal ether groups; or (iii) a polyether containing one or more ester groups and one or more terminal amino groups wherein a terminal group is defined as a group located within five connecting carbon or oxygen atoms from the end of the polymer. Connecting is defined as the sum of the connecting carbon and oxygen atoms in the polymer or end group.

An alkoxylate can be represented by the formula (VI):

(VI)

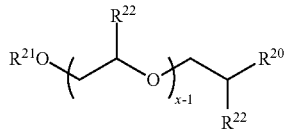

wherein, $R^{21}$ is TC(O)— wherein T is a hydrocarbyl derived from tallow fatty acid; $R^{20}$ is OH, A, WC(O)—, or mixtures thereof, wherein A is $—OCH_2CH_2CH_2NR^{23}R^{23}$ or $—NR^{24}R^{24}$, where each $R^{23}$ is independently hydrogen or hydrocarbyl, and each $R^{24}$ is independently hydrogen, hydrocarbyl or $—[R^{25}N(R^{26})]pR^{26}$ where $R^{25}$ is $C_{2-10}$-alkylene, each $R^{26}$ is independently hydrogen or hydrocarbyl, and p is a number from 1-7, W is a $C_{1-36}$ hydrocarbyl group; $R^{22}$ is H, $—CH_3$, $—CH_2CH_3$ or mixtures thereof; and X is an integer from 1 to 36.

Examples of the alkoxylate can include: $C_{12-15}$ alcohol initiated polypropyleneoxide (22-24) ether amine, Bayer ACTACLEAR ND21-A™ ($C_{12-15}$ alcohol initiated polypropyleneoxide (22-24) ether-ol), tall oil fatty acid initiated polypropyleneoxide (22-24) ester-ol, butanol initiated polypropyleneoxide (23-25) ether-tallow fatty acid ester, glycerol dioleate initiated polypropyleneoxide (23-25) ether-ol, propylene glycol initiated polypropyleneoxide (33-34) ether tallow fatty acid ester, tallow fatty acid initiated polypropyleneoxide (22-24) ester-ol and $C_{12-15}$ alcohol initiated polypropyleneoxide (22-24) ether tallow fatty acid ester.

These alkoxylates can be made from the reaction of a fatty acid such as tall oil fatty acids (TOFA), that is, the mixture of fatty acids predominately oleic and linoleic and contains residual rosin acids or tallow acid that is, the mixture of fatty acids are predominately stearic, palmitic and oleic with an alcohol terminated polyether such as polypropylene glycol in the presence of an acidic catalyst, usually methane sulfonic acid. These alkoxylates can also be made from the reaction of glycerol dioleate and propylene oxide in the presence of catalyst.

Detergent

In one embodiment, the detergent can be a Mannich detergent, sometimes referred to as a Mannich base detergent. A Mannich detergent is a reaction product of a hydrocarbyl-substituted phenol, an aldehyde, and an amine or ammonia. The hydrocarbyl substituent of the hydrocarbyl-substituted phenol can have 10 to 400 carbon atoms, in another instance 30 to 180 carbon atoms, and in a further instance 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent can be prepared by polymerizing olefin monomers by well-known polymerization methods and are also commercially available. The olefin monomers include monoolefins, including monoolefins having 2 to 10 carbon atoms such as ethylene, propylene, 1-butene, isobutylene, and 1-decene. An especially useful monoolefin source is a C4 refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins. Useful polyolefins include polyisobutylenes having a number average molecular weight of 140 to 5000, in another instance of 400 to 2500, and in a further instance of 140 or 500 to 1500. The polyisobutylene can have a vinylidene double bond content of 5 to 69 percent, in a second instance of 50 to 69 percent, and in a third instance of 50 to 95 percent or mixtures thereof. The polyolefin can be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers.

The hydrocarbyl-substituted phenol can be prepared by alkylating phenol with an olefin or polyolefin described above, such as a polyisobutylene or polypropylene, using well-known alkylation methods.

The aldehyde used to form the Mannich detergent can have 1 to 10 carbon atoms, and is generally formaldehyde or a reactive equivalent thereof such as formalin or paraformaldehyde.

The amine used to form the Mannich detergent can be a monoamine or a polyamine, including alkanolamines having one or more hydroxyl groups, as described in greater detail above. Useful amines include those described above, such as ethanolamine, diethanolamine, methylamine, dimethylamine, ethylenediamine, dimethylaminopropylamine, diethylenetriamine and 2-(2-aminoethylamino) ethanol. The Mannich detergent can be prepared by reacting a hydrocarbyl-substituted phenol, an aldehyde, and an amine as described in U.S. Pat. No. 5,697,988. In one embodiment, the Mannich reaction product is prepared from an alkylphenol derived from a polyisobutylene, formaldehyde, and an amine that is a primary monoamine, a secondary monoamine, or an alkylenediamine, in particular, ethylenediamine or dimethylamine.

The Mannich reaction product can be prepared by well-known methods generally involving reacting the hydrocarbyl substituted hydroxy aromatic compound, an aldehyde and an amine at temperatures between 50 to 200° C. in the presence of a solvent or diluent while removing reaction water as described in U. S. Pat. No. 5,876,468.

In yet another embodiment, the detergent can be a polyisobutylene amine. The amine use to make the polyisobutylene amine can be a polyamine such as ethylenediamine, 2-(2-aminoethylamino)ethanol, or di ethylenetriamine. The polyisobutylene amine can be prepared by several known methods generally involving amination of a derivative of a polyolefin to include a chlorinated polyolefin, a hydroformylated polyolefin, and an epoxidized polyolefin. In one embodiment, the polyisobutylene amine is prepared by chlorinating a polyolefin such as a polyisobutylene and then reacting the chlorinated polyolefin with an amine such as a polyamine at elevated temperatures of generally 100 to 150° C. as described in U.S. Pat. No. 5,407,453. To improve processing, a solvent can be employed, an excess of the amine can be used to minimize cross-linking, and an inorganic base such as sodium carbonate can be used to aid in removal of hydrogen chloride generated by the reaction.

Yet another type of suitable detergent is a glyoxylate. A glyoxylate detergent is a fuel soluble ashless detergent which, in a first embodiment, is the reaction product of an amine having at least one basic nitrogen, i.e. one >N—H, and a hydrocarbyl substituted acylating agent resulting from the reaction, of a long chain hydrocarbon containing an olefinic bond with at least one carboxylic reactant selected from the group consisting of compounds of the formula (VII)

$$(R^1C(O)(R^2)_nC(O))R^3 \quad \text{(VII)}$$

and compounds of the formula (VIII)

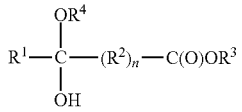

(VIII)

wherein each of $R^1$, $R^3$ and $R^4$ is independently H or a hydrocarbyl group, $R^2$ is a divalent hydrocarbylene group having 1 to 3 carbons and n is 0 or 1.

Examples of carboxylic reactants are glyoxylic acid, glyoxylic acid methyl ester methyl hemiacetal, and other omega-oxoalkanoic acids, keto alkanoic acids such as pyruvic acid, levulinic acid, ketovaleric acids, ketobutyric acids and numerous others. Persons of ordinary skill in the art will readily recognize the appropriate compound of formulas (VII) or (VIII) to employ as a reactant to generate a given intermediate.

The hydrocarbyl substituted acylating agent can be the reaction of a long chain hydrocarbon containing an olefin and the above described carboxylic reactant of formula (VII) and (VIII), further carried out in the presence of at least one aldehyde or ketone. Typically, the aldehyde or ketone contains from 1 to about 12 carbon atoms. Suitable aldehydes include formaldehyde, acetaldehyde, propionaldehyde, butyraldehyde, isobutyraldehyde, pentanal, hexanal, heptaldehyde, octanal, benzaldehyde, and higher aldehydes. Other aldehydes, such as dialdehydes, especially glyoxal, are useful, although monoaldehydes are generally preferred. Suitable ketones include acetone, butanone, methyl ethyl ketone, and other ketones. Typically, one of the hydrocarbyl groups of the ketone is methyl. Mixtures of two or more aldehydes and/or ketones are also useful. Compounds and the processes for making these compounds are disclosed in U.S. Pat. Nos. 5,696,060; 5,696,067; 5,739,356; 5,777,142; 5,856,524; 5,786,490; 6,020,500; 6,114,547; 5,840,920 and are incorporated herein by reference.

In another embodiment, the glyoxylate detergent is the reaction product of an amine having at least one basic nitrogen, i.e. one >N—H, and a hydrocarbyl substituted acylating agent resulting from the condensation product of a hydroxyaromatic compound and at least one carboxylic reactant selected from the group consisting of the above described compounds of the formula (VII) and compounds of the formula (VIII). Examples of carboxylic reactants are glyoxylic acid, glyoxylic acid methyl ester methyl hemiacetal, and other such materials as listed above.

The hydroxyaromatic compounds typically contain directly at least one hydrocarbyl group R bonded to at least one aromatic group. The hydrocarbyl group R may contain up to about 750 carbon atoms or 4 to 750 carbon atoms, or 4 to 400 carbon atoms or 4 to 100 carbon atoms. In one embodiment, at least one R is derived from polybutene. In another embodiment, R is derived from polypropylene.

In another embodiment, the reaction of the hydroxyaromatic compound and the above described carboxylic acid reactant of formula (VII) or (VIII) can be carried out in the presence of at least one aldehyde or ketone. The aldehyde or ketone reactant employed in this embodiment is a carbonyl compound other than a carboxy-substituted carbonyl compound. Suitable aldehydes include monoaldehydes such as formaldehyde, acetaldehyde, propionaldehyde, butyraldehyde, isobutyraldehyde, pentanal, hexanal, heptaldehyde, octanal, benzaldehyde, and higher aldehydes. Other aldehydes, such as dialdehydes, especially glyoxal, are useful. Suitable ketones include acetone, butanone, methyl ethyl ketone, and other ketones. Typically, one of the hydrocarbyl groups of the ketone is methyl. Mixtures of two or more aldehydes and/or ketones are also useful. Compounds and the processes for making these compounds are disclosed in U.S. Pat. Nos. 3,954,808; 5,336,278; 5,620,949 and 5,458,793 and are incorporated herein by reference.

The detergent additive can be present in a mixture of various detergents referenced above. In one embodiment, the detergent additive can be present in the additive composition at about 3 to about 60% by weight, or from about 3 to about 50% by weight, or from about 3 to about 20% weight by weight, or from about 10 to about 20% by weight.

The detergent additive can be present in a fuel composition in one embodiment on a weight basis at 1 to 10,000 ppm (parts per million), and in other embodiments can be present at 10 to 5,000 ppm, at 10 to 3000 ppm, at 10 to 1000, or at 10 to 600 or at 10 to 300 ppm.

The amine salt may be added directly to an unadditized or additized fuel. The amine salt may also be added to a fuel as part of an additive concentrate, or additive package. Exemplary additive packages are shown in Table 1 below.

TABLE 1

| Additive | Additive Packages (wt %) | | |
|---|---|---|---|
| | A | B | C |
| Amine Salt | 0.1 to 20 | 0.5 to 15 | 1 to 10 |
| Friction Modifier (optional) | 0.1 to 20 | 0.5 to 15 | 1 to 10 |
| Organic Solvent (xylene) | 0 to 70 | 0 to 50 | 0 to 40 |
| Organic Solvent (2-ethylhexanol) | 0 to 40 | 0 to 30 | 0 to 20 |
| Organic Solvent (HAN) | 0 to 40 | 0 to 35 | 0 to 30 |
| Fluidizer (polyether) | 0 to 40 | 0 to 30 | 0 to 20 |
| Detergent (polyetheramine) | 0 to 70 | 0 to 50 | 0 to 30 |
| Detergent (Mannich) | 0 to 70 | 20 to 60 | 30 to 50 |
| Detergent (PIB-amine) | 0 to 70 | 20 to 60 | 30 to 50 |
| Demulsifier (polyalkoxylated alcohol) | 0 to 5 | 0 to 3 | 0 to 1 |
| Corrosion Inhibitor (PIB-succinic acid) | 0 to 3 | 0 to 2 | 0 to 1 |
| Total (total of the above additives)* | 100 | 100 | 100 |

*Persons of ordinary skill in the art will understand that the amount of each additive for an additive package will be selected such that the total will equal 100% even if the ranges listed in the table may not equal 100%.

The fuel compositions may be prepared by combining the fuel, additives, and/or oxygenates prior to putting the fuel in a vehicle. For example, the amine salt may be added and mixed together with a fuel at concentrations of at least 10 ppm. The additized fuel may then be pumped into the fuel tank. In other embodiments, the fuel may be added to the fuel tank of a vehicle and the amine salt may be added to a separate dosing tank in the vehicle. The amine salt may then be dosed to the fuel at concentrations of at least 10 ppm as the vehicle is operating. This is known as "onboard dosing".

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

It is known that some of the materials described above may interact in the final formulation, so that the components of the final formulation may be different from those that are initially added. The products formed thereby, including the products formed upon employing the compositions disclosed herein may not be susceptible of easy description. Nevertheless, all such modifications and reaction products are included within the scope of the disclosed technology, including compositions prepared by admixing the components described above.

INDUSTRIAL APPLICATION

In one embodiment the fuel compositions described above are useful for liquid fuel engines and/or for spark ignited engines and can include engines for hybrid vehicles and stationary engines. The type of engine is not overly limited and includes, but is not limited to, V, inline, opposed, and rotary engines. The engines may be naturally aspirated, boosted, E-boosted, supercharged, or turbocharged engines. The engine may be a carbureted or fuel injected gasoline engine. As such, the engine may have a carburetor or injectors (including piezo injectors).

In one embodiment, the engine may be a gasoline direct injection ("GDI") engine (spray or wall guided, or combinations thereof), a port fuel injection ("PFI") engine, a homogeneous charge compression ignition ("HCCI") engine, stoichiometric burn or lean burn engines, spark controlled compression ignition ("SPCCI") engine, variable compression, Miller cycle or Atkinson cycle engines, or a combination thereof, such as an engine that contains both GDI and PFI injectors in the same engine. Suitable GDI/PFI engines includes 2-stroke or 4-stroke engines fueled with gasoline, a mixed gasoline/alcohol or any of the fuel compositions described in the sections above. The additive composition can reduce wear in, and/or improve fuel economy of, an engine, such as a GDI/PFI engine. In yet other embodiments, the fuel compositions may be prepared using an on-board dosing system for either a GDI engine, a PFI engine, or a combination thereof.

In yet other embodiments any of the above engines may be equipped with a catalyst or device for treating exhaust emissions, such as reducing NOx. In other embodiments the engine may be a flexible-fuel engine able to operate on more than one fuel type, typically, gasoline and ethanol or gasoline and methanol. In yet other embodiments, any of the above engine types may be in a hybrid vehicle that also includes an electric motor.

The fuel compositions described above may be used to reduce carbonaceous deposits in an engine operated on the fuel. The amine salt may be present in the fuel composition in an amount of at least 10 ppm, 12 ppm, 25 ppm, or 50 ppm to 100ppm, 500 or 2500 ppm, based on a total weight of the fuel composition.

The disclosed technology may be further illustrated by the following examples.

EXAMPLES

Additive packages are prepared as listed in Table 2. The packages are mixed and heated to 80° C. and then held at temperature for 30 minutes. The prepared samples are then allowed to cool to room temperature before they are added to a fuel.

TABLE 2

| ADDITIVE (wt %) | Comp A | Ex A[1] | Ex B[2] |
|---|---|---|---|
| Amine Salt | — | 100 | 100 |
| Friction Modifier (polyoxyethylene tallow amine) | 8.18 | — | — |
| Friction Modifier (polyol ester oleate) | 8.18 | — | — |
| Deposit Control Additive (Mannich) | 25.96 | — | — |
| Fluidizer (Propoxylated Alcohol) | 11.72 | — | — |
| Organic Solvent (2-ethylhexanol) | 10 | — | — |
| Organic Solvent (HAN) | 35.96 | — | — |

[1]The Amine Salt is the product of N-hexadecenylsuccinic anhydride ("HDSA") and N,N-dimethylethanolamine.
[2]The Amine Salt is the product of a 550 $M_n$ polyisobutylene ("PIB") and N,N-dimethylethanolamine Comparative Example A ("Comp A") and Inventive Examples A and B ("Ex A" and "Ex B" respectively) are added to different samples of unadditized gasoline at the treat rates shown in Table 3 below.

TABLE 3

| | Additive Treat Rate (ppm) | | |
|---|---|---|---|
| Example | Comp A | Ex A | Ex B |
| Baseline (unadditized gasoline) | — | — | — |
| Comp 1 | 3000 | — | — |
| Ex 1 | — | 286 | — |
| Ex 2 | — | — | 286 |
| Ex 3 | — | 100 | — |
| Ex 4 | — | — | 100 |

The performance of each fuel is then tested in a GDI engine. The tests utilizes a 2013 GM 2.0L ECOTEC turbo LHU GDI engine. For each test, new injectors are used and the flow through the injectors is tested at 35 Bar and 100 Bar before and after each test. Long term fuel trim ("LTFT") is collected during each cycle of the engine test. Fuel trim is an adaptive strategy that adjusts fuel injector open time ("fuel flow") to adapt to changes in the engine and is accumulated over time as the engine control module tries to maintain a steady air/fuel ratio. Injector open time is adjusted accordingly based on the oxygen sensor input.

Each cycle consists of 6 engine modes. The engine modes are shown in Table 4 below.

TABLE 4

| Mode | Engine Speed Setpoint (RPM) | Engine Torque Setpoint (N-m) | Duration (sec) |
|---|---|---|---|
| 1 | 2100 | 65 | 678 |
| 2 | 1630 | 52 | 910 |
| 3 | 2100 | 65 | 600 |
| 4 | 1630 | 52 | 1400 |
| 5 | 1325 | 41 | 1010 |
| 6 | 1630 | 52 | 910 |

Changes in fuel trim are often the result of fouled injectors and linked to decreased fuel flow or disruption in spray. Examination of the fuel trim and injector flow data, along with visual inspection of the injector tips provides a way to differentiate fuel and fuel additive performance.

The tests may have one or more "dirty-up" ("DU") cycles wherein unadditized fuel is used in the engine to generate a build-up of injector deposits and one or more clean-up ("CU") cycles wherein additized fuel is used in the engine to clean-up the deposits formed during the DU cycle. A LTFT with a positive slope is an indication that the injection duration has been increased to compensate for less fuel flow due to deposits forming in the injector(s). A LTFT with a negative slope is an indications that deposits are being removed from the injector(s). Alternatively, the test may be a "keep-clean" test wherein only additized fuel is used in the engine and the change in LTFT is monitored during the duration of the test. A LTFT slope of about 0 indicates that the additive is effectively keeping an engine clean of deposits.

Figure 2:
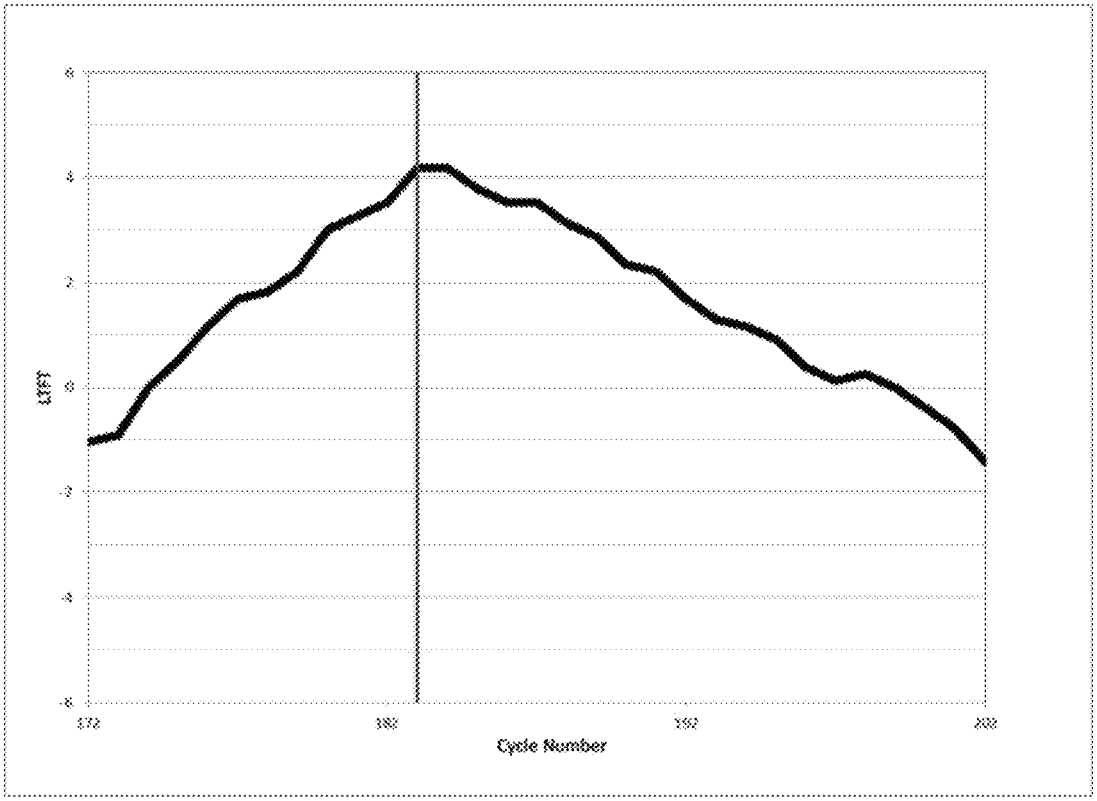
FIG. 2 shows the dirty-up cycles of the baseline unadditized gasoline followed by the clean-up cycles of Ex 1, a gasoline having 286 ppm of Ex A.
Figure 3:
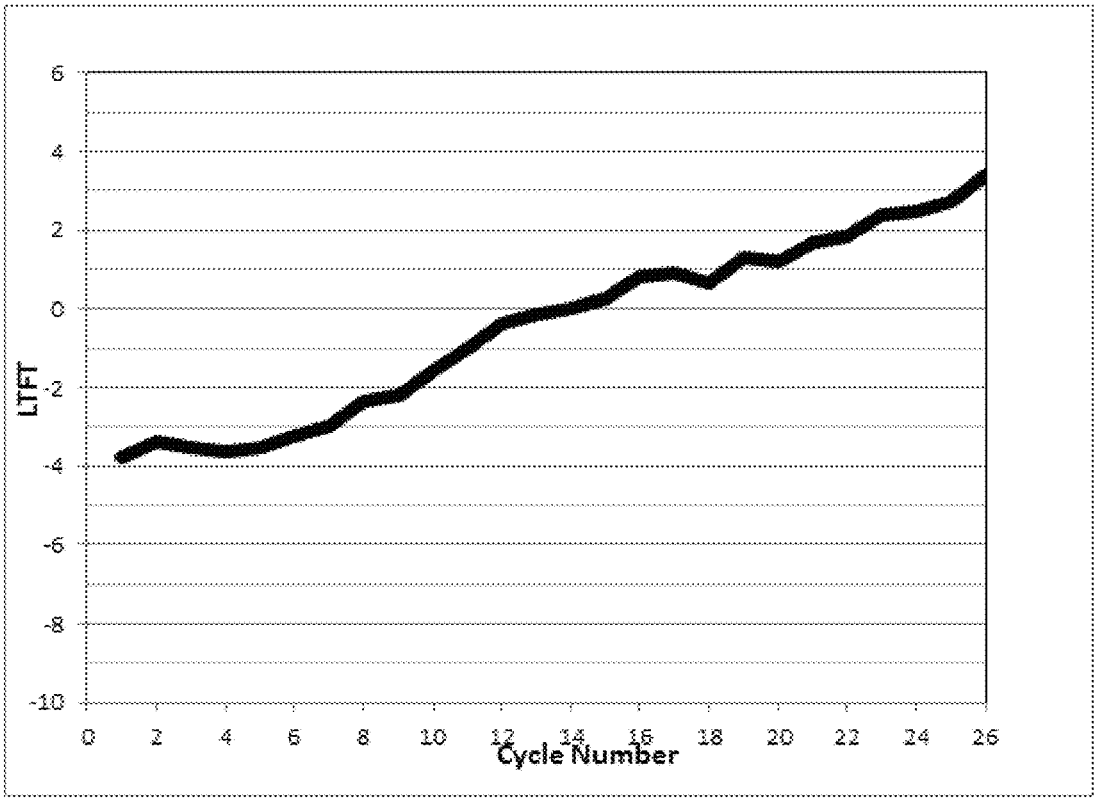
FIG. 3 shows the LTFT of a keep-clean test of the baseline unadditized gasoline.
Figure 4:
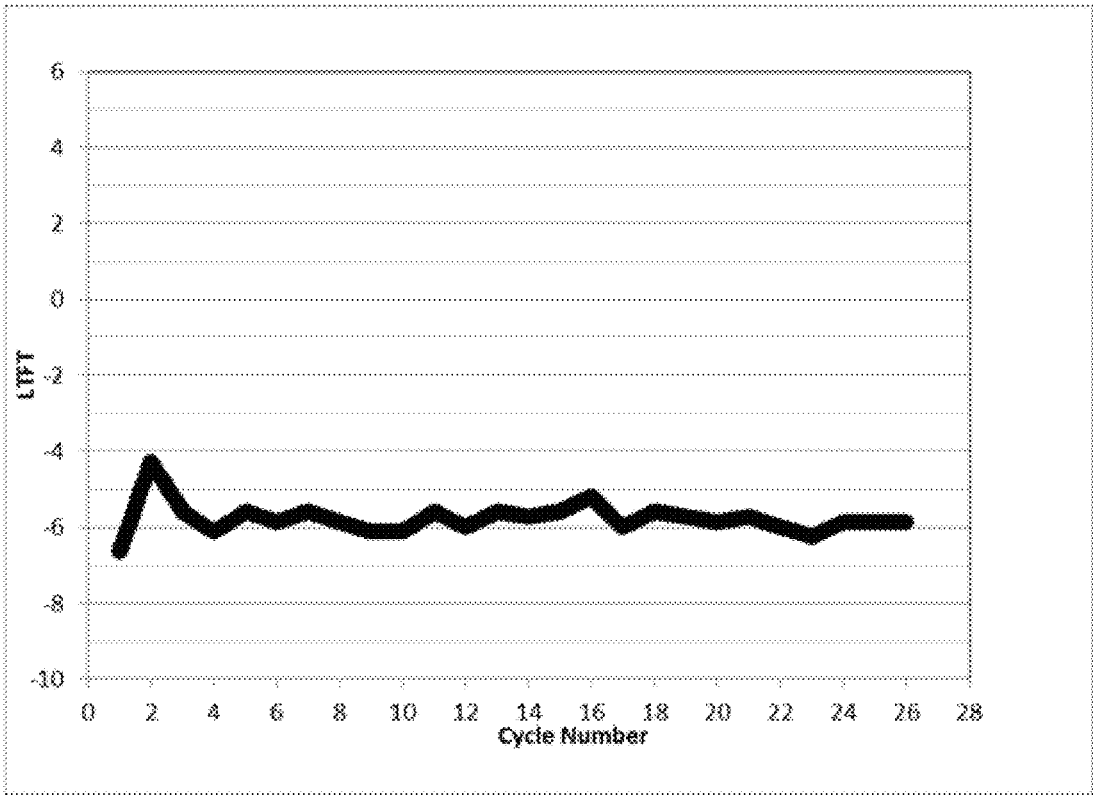
FIG. 4 shows the LTFT of a keep-clean test of EX 3, a gasoline having 100 ppm of Ex A.
Figure 5:
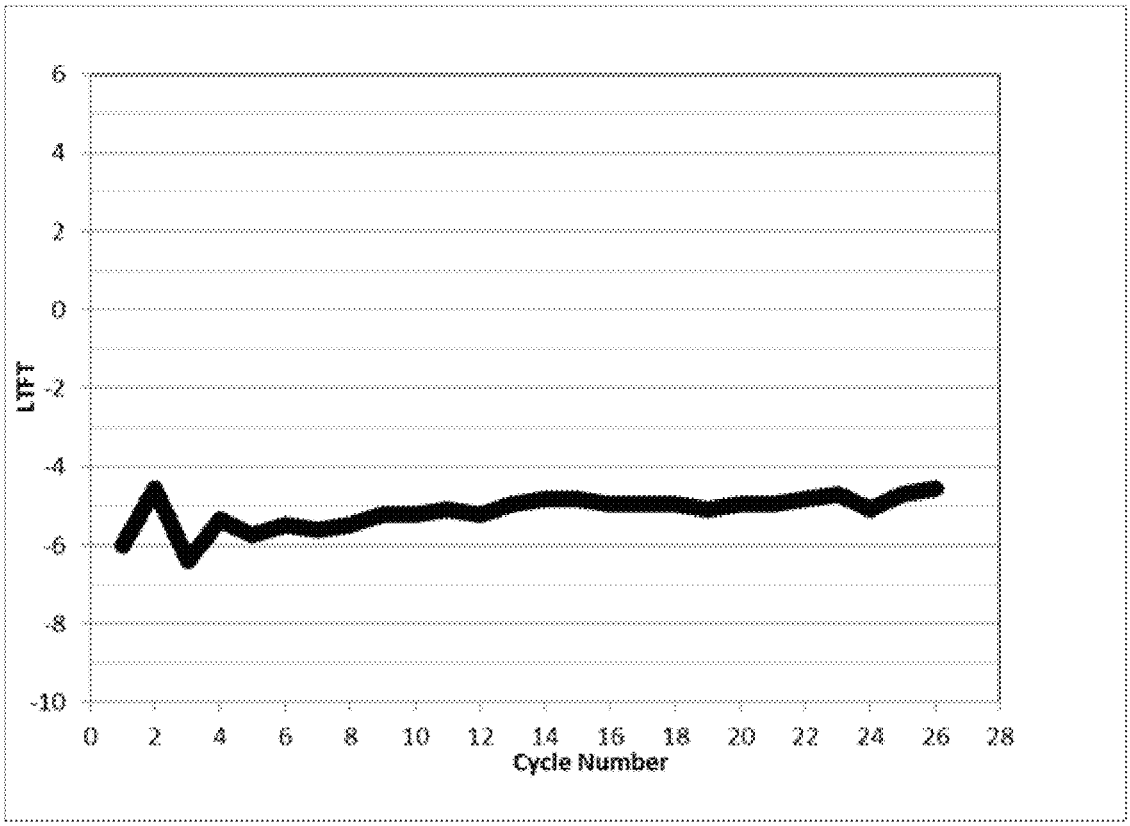
FIG. 5 shows the LTFT of a keep-clean test of EX 4, a gasoline having 100 ppm of Ex B.

FIG. 1 shows the dirty-up cycles of the baseline unadditized gasoline, followed by the clean-up cycles of Comp 1, a gasoline having 3000 ppm of Comp A. The clean-up slope of Comp 1 is −0.25. FIG. 2 shows the dirty-up cycles of the baseline unadditized gasoline followed by the clean-up cycles of Ex 1, a gasoline having 286 ppm of Ex A. The clean-up slope of Ex 1 is −0.29, thus Ex 1 results in a faster engine clean-up than Comp 1, even at lower treat rates. FIG. 3 shows the LTFT of a keep-clean test of the baseline unadditized gasoline. FIG. 4 shows the LTFT of a keep-clean test of EX 3, a gasoline having 100 ppm of Ex A. FIG. 5 shows the LTFT of a keep-clean test of EX 4, a gasoline having 100 ppm of Ex B. FIGS. 4 and 5 both show that the amine salts are effective at keeping an engine clean of deposits, even after 26 cycles.

In some embodiments, the amine salt's performance in a fuel may be evaluated by measuring an engine's mean effective pressure ("MEP") when operated using the additized fuel. The MEP measures an engine's capacity to do work independently from engine displacement and can aid in comparing the performance of different engine types or the performance of the same engine operated on different fluids. Various ways of calculating MEP are known to persons ordinarily skilled in the art and include, but are not limited to, brake MEP, friction MEP, gross indicated MEP, net indicated MEP, and pumping MEP. Brake MEP ("BMEP") is calculated as a function of brake torque. In some embodiments, the amine salt may improve an engine's BMEP.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A fuel composition comprising gasoline, oxygenate, or mixtures thereof and a succinic ester acid amine salt or a succinamide acid amine salt (both "amine salt(s)") that is the product of (a) and (b), wherein:

(a) is an amine with (i) at least one tertiary nitrogen and (ii) at least one hydroxy alkyl functionality and/or at least one secondary amine functionality;

(b) is a hydrocarbyl-substituted succinic acid and/or anhydride; and wherein said amine salt has a concentration of at least 10 ppm by weight, based on a total weight of said fuel composition; and wherein at least a portion of the amine salt has the formula:

(I)

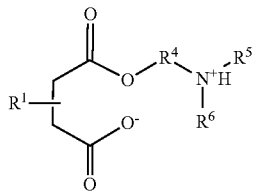

wherein $R^1$ is hydrogen or a $C_1$ to $C_{50}$ linear or branched hydrocarbyl group; $R^4$ is a $C_1$ to $C_5$ linear or branched hydrocarbyl group; and $R^5$ and $R^6$, are independently a $C_1$ to $C_{22}$ linear or branched hydrocarbyl group, or are moieties which, when taken together, form a 5-, 6-, or 7-membered ring and/or (II)

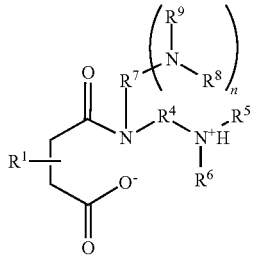

wherein $R^1$ is hydrogen or a $C_1$ to $C_{50}$ linear or branched hydrocarbyl group; $R^4$ and $R^7$ are independently a $C_1$ to $C_5$ linear or branched hydrocarbyl group; and $R^5$, $R^6$, are independently a $C_1$ to $C_{22}$ linear or branched hydrocarbyl group, or are moieties which, when taken together, form a 5-, 6-, or 7-membered ring, n is 0 or 1, and $R^8$ and $R^9$ are independently hydrogen or a $C_1$ to $C_{22}$ linear or branched hydrocarbyl group, or are moieties which, when taken together, form a 5-, 6-, or 7-membered ring.

2. The fuel composition of claim 1, wherein the molar ratio of (a) to (b) ranges from 3:1 to 1:3.

3. The fuel composition of claim 1, wherein $R^1$ is a $C_8$ to $C_{25}$ or $C_{12}$ to $C_{16}$ hydrocarbyl group.

4. The fuel composition of claim 1, wherein the amine salt has the formula (I) and is the product of N-methyldiethanolamine and hexadecenylsuccinic anhydride.

5. The fuel composition of claim 1, wherein the amine salt has the formula (II) and is the product of N1-(3-(dimethylamino)propyl)-N3,N3-dimethylpropane-1,3-diamine and hexadecenylsuccinic anhydride.

6. The fuel composition of claim 1, wherein the amine is an alkoxylated fatty amine.

7. The fuel composition of claim 1, further comprising an alkoxylated fatty amine in addition to the amine used to make the reaction product of the amine salt.

8. The fuel composition of claim 6 or 7, wherein said alkoxylated fatty amine has the formula (III):

(III)

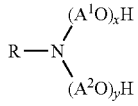

wherein R is a $C_4$ to $C_{30}$ hydrocarbyl group; $A^1$ and $A^2$ are individually a $C_1$ to $C_{10}$ alkylene group; and the sum of x and y is an integer of at least 1.

9. The fuel composition of claim 1, wherein said amine salt has a concentration of at least 12 ppm, 25 ppm, or 50 ppm, based on a total weight of said fuel composition.

10. The fuel composition of claim 1, wherein said fuel composition comprises 0.1 vol % to 100 vol % oxygenate, based on a total volume of said fuel composition.

11. The fuel composition of claim 1, wherein said fuel composition comprises 0.1 vol % to 100 vol % gasoline, based on a total volume of said fuel composition.

12. The fuel composition of claim 10, wherein said oxygenate is ethanol.

13. A method of reducing carbonaceous deposits in an engine, said method comprising operating said engine using the fuel composition of claim 1.

14. The method of claim 13, wherein said amine salt is present in an amount of at least 20 ppm to 100 ppm (keep clean), or at least 100 ppm to 500 ppm (clean-up).

15. The method of claim 13, wherein said engine is an internal combustion gasoline engine.

16. The method of claim 15, wherein said internal combustion gasoline engine, is a gasoline direct injection ("GDI") engine, a port fuel injection ("PFI") engine, a homogeneous charge compression ignition ("HCCI") engine, or a combination thereof.

17. The method of claim 13, wherein said amine salt is added to said fuel using an onboard dosing system.

18. The fuel composition of claim 1, wherein the amine salt has the formula (I) and is the product of N,N-dimethylethanolamine and hexadecenylsuccinic anhydride.

* * * * *